US006694543B2

(12) United States Patent
Moore

(10) Patent No.: US 6,694,543 B2
(45) Date of Patent: Feb. 24, 2004

(54) COMPRESSION MOUNT FOR A SHOWER CURTAIN ROD

(76) Inventor: Sean A. Moore, 3139 W. Holcombe Blvd., Suite 635, Houston, TX (US) 77025

( * ) Notice: Subject to any disclaimer, the term of this patent is extended or adjusted under 35 U.S.C. 154(b) by 0 days.

(21) Appl. No.: 10/152,288

(22) Filed: May 21, 2002

(65) Prior Publication Data

US 2003/0217410 A1 Nov. 27, 2003

(51) Int. Cl.[7] ..... A47K 3/022; A47K 3/34; A47K 3/36

(52) U.S. Cl. ..... 4/610; 4/607; 4/557; 248/261; 248/264; 248/265

(58) Field of Search ..... 4/558, 610, 608, 4/557, 607; 211/123, 105.4; 248/251, 261–5, 200.1, 270; 16/93 D, 95 D, 96 D; 160/330, 350

(56) References Cited

U.S. PATENT DOCUMENTS

| | | | | | |
|---|---|---|---|---|---|
| 839,959 | A | | 1/1907 | Richards | |
| 912,789 | A | | 2/1909 | Berbecker | |
| 1,256,849 | A | * | 2/1918 | Vaudreuil | 211/123 |
| 1,487,017 | A | | 3/1924 | Lilja | |
| 1,681,010 | A | * | 8/1928 | Raggio | 211/123 |
| 2,195,979 | A | | 4/1940 | Ziolkowski | |
| 2,219,075 | A | | 10/1940 | Le Veau | |
| 2,573,985 | A | | 11/1951 | Porter | |
| 2,650,714 | A | | 9/1953 | Brose et al. | |
| 2,698,094 | A | * | 12/1954 | Simpson | 211/105.3 |
| 2,774,974 | A | | 12/1956 | Zaloga | |
| 2,778,030 | A | | 1/1957 | Goché | |
| 2,796,227 | A | | 6/1957 | Coakley | |
| 2,890,799 | A | | 6/1959 | Rosenbaum | |
| 3,418,665 | A | | 12/1968 | Long | |
| 3,521,758 | A | * | 7/1970 | Guilfoyle | 211/105.4 |
| 3,872,520 | A | | 3/1975 | Tyconik | |
| D236,864 | S | | 9/1975 | Tegner | |
| 4,117,557 | A | * | 10/1978 | McPeak et al. | 4/610 |
| 4,229,842 | A | | 10/1980 | Gilmore | |
| 4,361,914 | A | * | 12/1982 | Oliver | 4/605 |
| 4,496,059 | A | | 1/1985 | Leiter | |
| 4,754,504 | A | | 7/1988 | Cellini | |
| 4,775,056 | A | * | 10/1988 | Inglis | 211/105.3 |
| 5,056,753 | A | * | 10/1991 | Lunau et al. | 248/542 |
| 5,231,708 | A | * | 8/1993 | Hansen | 4/608 |
| 5,281,063 | A | * | 1/1994 | Austin, III | 410/151 |
| 5,330,061 | A | * | 7/1994 | Geltz | 211/105.4 |
| 5,458,310 | A | * | 10/1995 | Johnson | 248/251 |
| 5,538,364 | A | * | 7/1996 | Huntsman | 405/288 |
| 5,894,610 | A | * | 4/1999 | Winter | 4/558 |
| 6,154,894 | A | * | 12/2000 | Alexander et al. | 4/609 |
| 6,216,287 | B1 | * | 4/2001 | Wise | 4/610 |

* cited by examiner

*Primary Examiner*—Henry Bennett
*Assistant Examiner*—Amanda Flynn
(74) *Attorney, Agent, or Firm*—Law Office of Tim Cook P.C.

(57) ABSTRACT

An adjustable, compressive mount for a shower curtain rod fits neatly within the curtain rod to maintain the esthetic appearance of the rod. A rotatable extension within the rod is moved in and out of the rod to alter the effective length of the rod. Extending the rod to fit within the enclosure provides a frictional fit against the opposing walls of the shower enclosure, without the need to place screws into the walls of the enclosure.

6 Claims, 3 Drawing Sheets

COMPRESSION MOUNT FOR A SHOWER CURTAIN ROD

FIELD OF THE INVENTION

The present relates generally to the field of shower enclosures and, more particularly, to an adjustable, compressive mount for a shower curtain rod. The compressive mount is adapted to permit the shower curtain rod to conform to practically any footprint of a shower area of a manufactured or custom shower installation without the need to make holes in the walls to which the mount attaches.

BACKGROUND OF THE INVENTION

In my U.S. Pat. No. 6,263,523, incorporated herein by reference, I described and taught a shower enclosure including a shower curtain rod which is shaped so that the bathroom is protected by draping the shower curtain in such a way that splashed water does not escape from the bath tub. The shower enclosure included an elongate arcuate rod having first and second spaced end portions, a pair of swivels, with one swivel at each of the end portions, and a pair of swivel-receiving wall mounts for mounting on opposing walls of the shower enclosure. In addition to retaining shower water within the enclosure, the elongate arcuate rod provides a much larger space for the one within the shower enclosure.

Preferably, the swivel-receiving wall mounts are to be secured to the walls of the shower enclosure by inserting screws through the mounts and into the walls of the shower enclosure. While the invention shown and claimed in my '523 patent has proven to be very successful, sold under the trademark CRESCENT ROD™, some folks who would really like to have the shower enclosure system of the '523 patent are reluctant to insert the preferred screws into the walls of the shower enclosure, particularly if the walls are made of ceramic or other kinds of tile. Further, apartment dwellers are often restricted from making holes in the walls or simply wish to take the product with them when they move assuming they had purchased it for their own use.

This recognized need in the art led to the present invention. Thus, there remains a need for a shower curtain that is configured to create a natural drape of the curtain that conforms to the curving portion of the tub, altering the conventional location and angle at which the curtain meets the wall to minimize the gap between the shower curtain and the shower wall and render harmless any water that should escape the curtain. Further, the curtain rod system should be adapted to maintain its position above the tub without the need to secure the mount to the enclosure with screws or the like. Inherent with the arcuate shape of the rod are forces of torque and rotation that resist a stable horizontal plane while in use not present in a conventional straight rod and which forces are not overcome by existing compression rod mounts.

Further, a tub fixture today commonly comes in one of a number of standard sizes. This standard size tub is put in place, and then a wall structure is completed adjacent or around the tub, generally on two or three sides of the tub. As the wall structure is installed, it is customized to fit over the rim or outer edge of the tub, and may encroach more or less over the top surface of the tub. Thus, the longitudinal distance that the curtain rod must span varies, often varying over an inch or more. The present invention is specially adapted to account for such variations in the size of the enclosure, while providing a robust mount for the curtain rod.

SUMMARY OF THE INVENTION

The present invention addresses these and other shortcomings of the prior art by providing an adjustable, compressive mount for a shower curtain rod which is shaped so that the bathroom is protected by draping the shower curtain in such a way that splashed water does not escape from the bath tub. The shower curtain rod, as in my '523 patent, includes straight end portions with an arcuate section between the end portions. The compressive mount fits neatly within the rod to maintain the esthetic appearance of the rod. A rotatable extension within the rod is moved in and out of the rod to alter the effective length of the rod. Extending the rod to fit within the enclosure provides a frictional fit against the opposing walls of the shower enclosure, without the need to place screws into the walls of the enclosure.

These and other features are described below, along with the accompanying drawings.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF PREFERRED EMBODIMENTS

Figure 1:
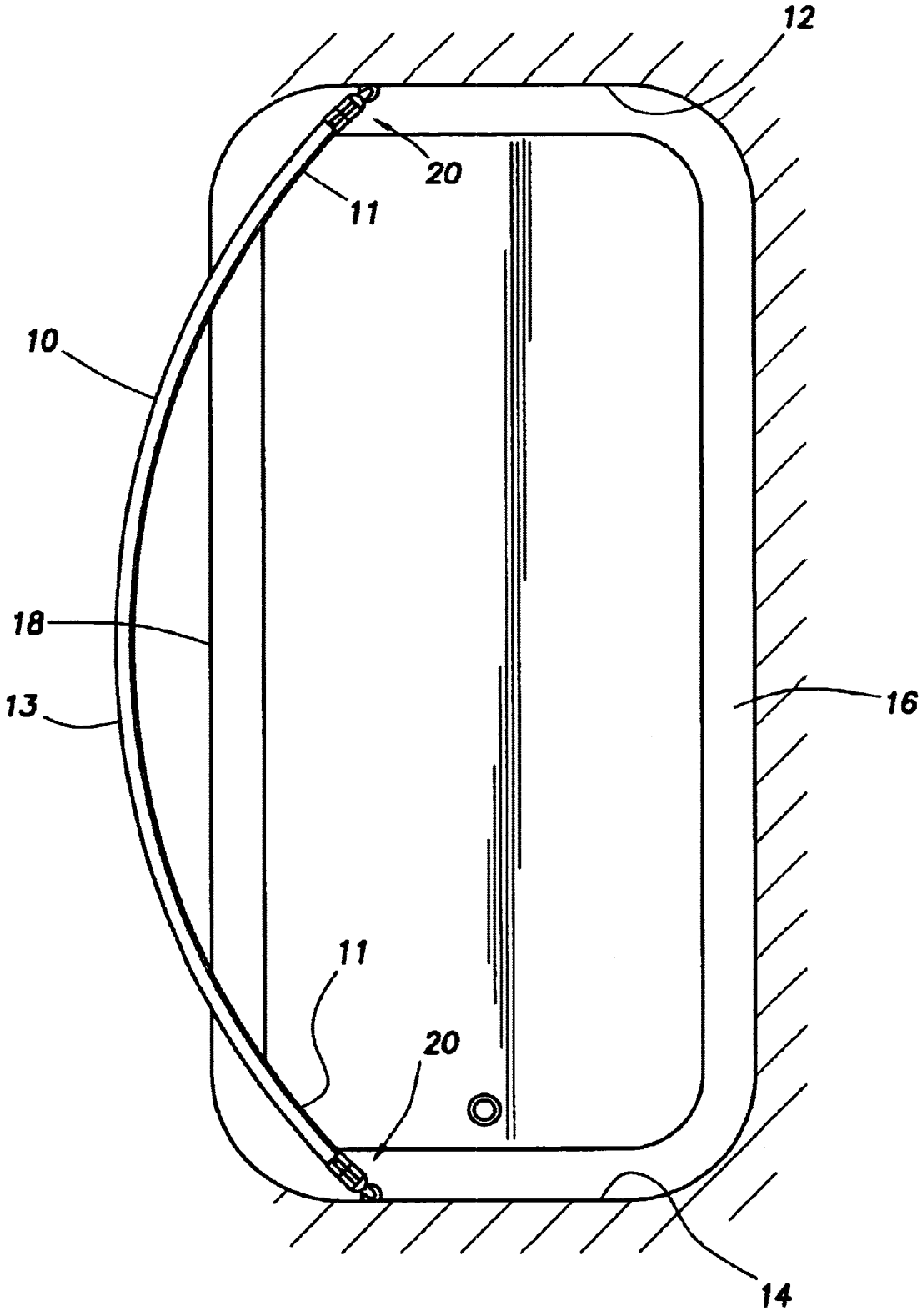
FIG. 1 is a top plan view of a bathtub in which the compressive mount of this invention is advantageously applied to retain an arcuate rod within a shower enclosure.

Referring first to FIG. 1, a curtain rod 10 is mounted to opposing walls 12 and 14 over a tub 16. The rod 10 extends beyond an outer edge 18 of the tub to provide an enlarged region within the tub for the user within. The rod 10 is coupled to the walls 12 and 14 with a compressive mount 20 as described below in greater detail in respect of FIGS. 2 and 3.

Figure 2:
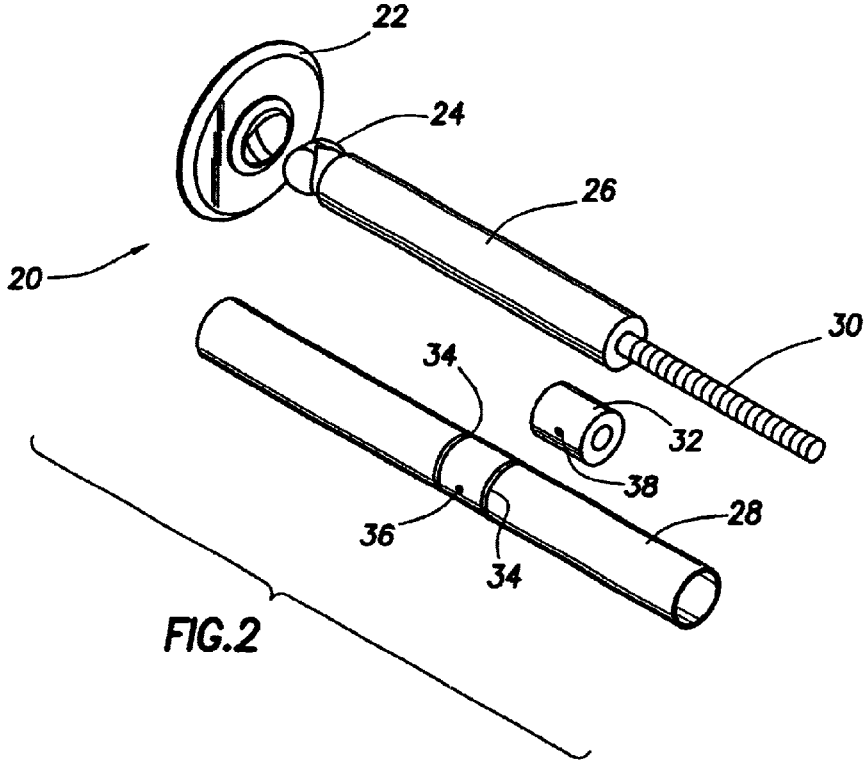
FIG. 2 is a perspective view of the compressive mount shown in a partially exploded condition.
Figure 3:
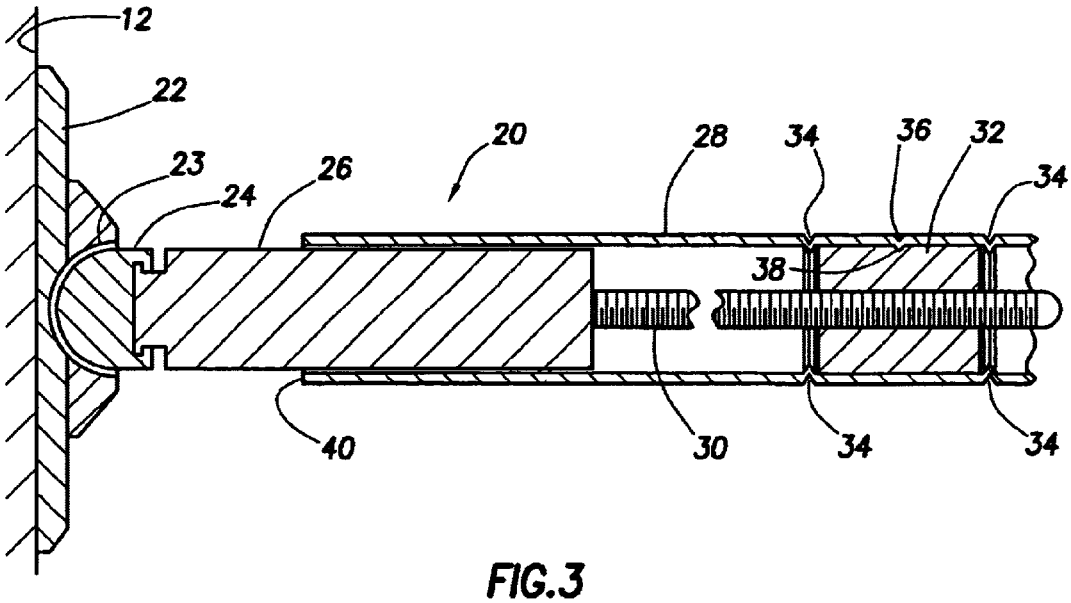
FIG. 3 is a side section view of the mount, shown mounted to an enclosure.

Referring now to FIGS. 2 and 3, the compressive mount 20 is illustrated in detail. The mount comprises a wall bracket or pedestal 22 adapted to receive a ball insert 24. The ball insert is rotatably secured to a sliding body 26 which is sized to slide easily within a shower curtain rod 28. Extending from the sliding body 26 is a threaded rod 30. The sliding body 26 and the threaded rod 30 are preferably joined together such that they rotate as a single unit, although they may alternatively be formed as one manufacture.

A threaded bushing 32 is about the same diameter as the sliding body 26 and also fits within the curtain rod 28. The threaded bushing 32 is smooth on the outside, but includes interior threads to thread onto the threaded rod 30. The threaded bushing 32 is held in place inside the curtain rod 28 by a pair of rolled retention grooves 34, which prevent axial movement of the bushing, and a punched dimple 36 in the curtain rod. The punched dimple 36 mates with a similar dimple 38 which is formed in the bushing 32 at the same time ad the dimple 36.

FIG. 3 illustrates these various components in a side section view of the compressive mount 20. As previously described, the mount comprises a wall bracket or pedestal 22, the bracket defining a receptacle 23 adapted to receive the ball insert 24. The ball insert is rotatably secured to the sliding body 26, and is joined to the body by any appropriate rotatable mounting, such as by swaging. The body 26 slides easily within the shower curtain rod 28. The threaded rod 30 threadedly engages the interior threads of the bushing 32 so that by rotating the body 26, which is manually accessible between the pedestal 22 and an end 40 of the curtain rod 28, the curtain rod is forced away from the wall 12, thereby creating a compressive force against the wall. The sliding body 26 and the threaded rod 30 are preferably joined together such that they rotate as a single unit. The threaded bushing 32 is about the same diameter as the sliding body 26 and also fits within the curtain rod 28, but is held immobile relative to the curtain rod 28 by the rolled retention grooves 34 and the dimples 36 and 38.

It should be noted that the pedestal 22 is preferably held against the wall simply by friction forces created by the compressive mount of the invention. Alternatively, if desired, an adhesive may be used to secure the pedestal in place, preferably an adhesive which permits the pedestal to be removed from the wall of the enclosure if desired.

Figure 4:
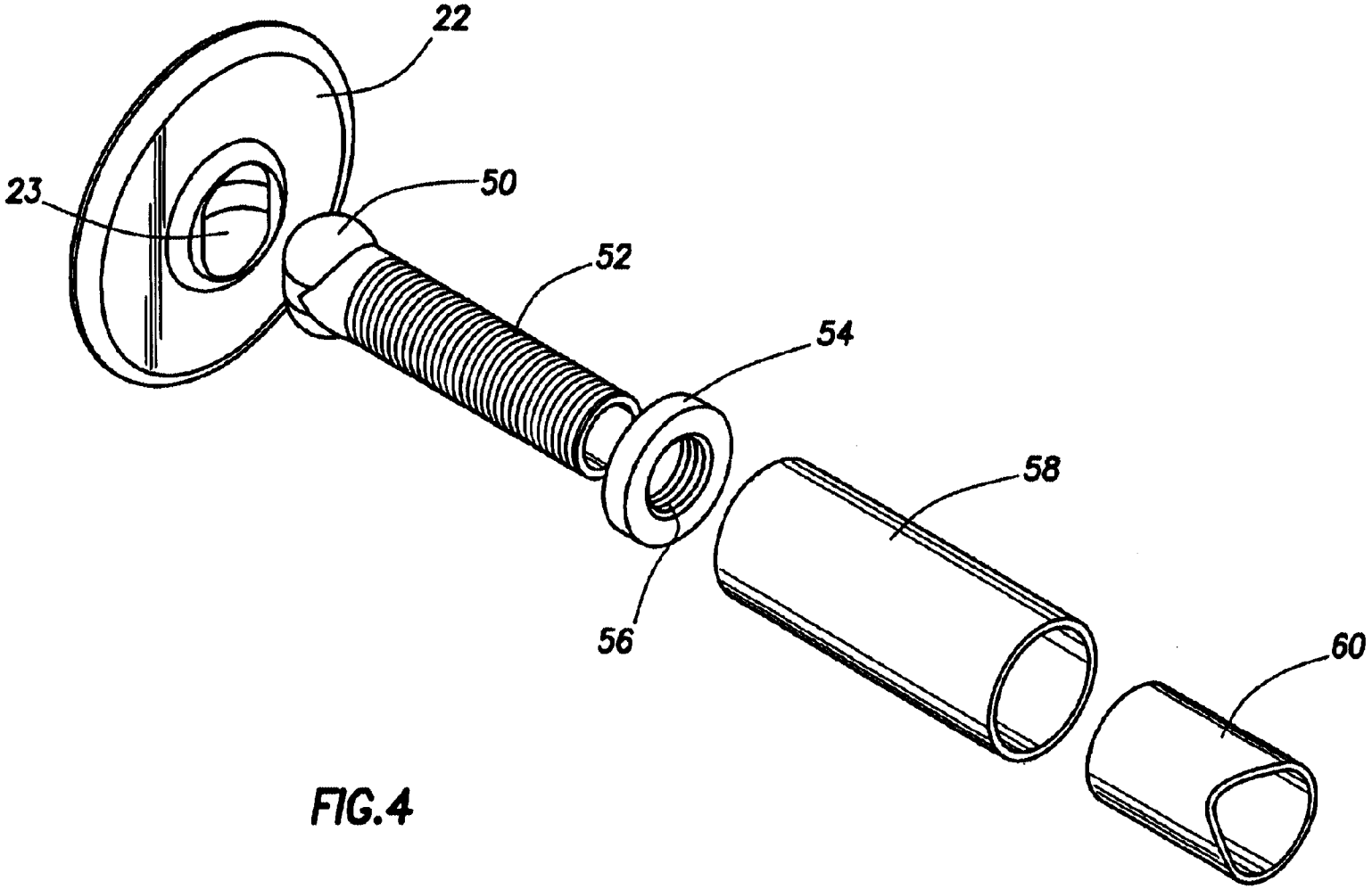
FIG. 4 is a perspective of another preferred embodiment of the compression mount of the invention.

FIG. 4 depicts an alternative, preferred embodiment of the invention. The pedestal 22 is constructed in the same way as previously described in respect of FIGS. 2 and 3, and defines an oblong receptacle 23 oriented along a vertical axis. In this embodiment, a male member defining a ball insert 50 is integrally formed with a threaded body 52 and does not swivel as previously described. A threaded washer 54 includes internal threads 56 to thread onto the threaded body 52, thereby defining the degree of compression to be generated by the compression mount. A sleeve 58 abuttingly engages the washer 54, and covers up more of less of the threads of the threaded member, depending on how far onto the body 52 the washer is advanced. The inside diameter of the sleeve 58 is sized to slidingly receive an end 60 of a curtain rod 10 (See also FIG. 1).

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

I claim:

1. In combination, a shower curtain rod and a mount for such a shower curtain rod, the combination comprising:

a. an arcuate tubular shower curtain rod;

b. a pedestal adapted to be held in contact with a wall and defining a receptacle;

c. a ball insert adapted to fit within the receptacle;

d. a sliding body rotatably joined to the ball insert and adapted to fit within the shower curtain rod;

e. a threaded rod extending axially from the sliding body and integrally formed with the sliding body; and f. a bushing having interior threads which engage the threaded rod, the bushing held stationary relative to the shower curtain rod.

2. The mount of claim 1, further comprising rolled retention grooves in the shower curtain rod and a dimple extending radially from the shower curtain rod into the bushing.

3. The mount of claim 2, wherein the grooves extend around the circumference of the shower curtain rod.

4. The mount of claim 1, wherein the receptacle defines an oblong opening oriented along a vertical axis.

5. In combination, a shower curtain rod and a mount for such a shower curtain rod, the combination comprising:

a. an arcuate tubular shower curtain rod;

b. a pedestal adapted to be held in contact with a wall and defining a receptacle;

c. a ball insert adapted to fit within the receptacle;

d. a threaded body integrally formed with the ball insert;

e. a threaded washer adapted to threadedly engage the threaded body; and f. a sleeve adapted for abutting engagement with the washer, the sleeve defining an inside diameter to slidingly engage an end of the shower curtain rod.

6. The mount of claim 5, wherein the receptacle defines an oblong opening oriented along a vertical axis.

* * * * *